US005605587A

United States Patent [19]

Meckling

[11] Patent Number: 5,605,587

[45] Date of Patent: Feb. 25, 1997

[54] APPARATUS FOR MAGNETIC CONDITIONING OF LIQUIDS AND METHODS OF MAKING SAME

[75] Inventor: John H. Meckling, Franklinton, La.

[73] Assignee: Hydrodynamics Corporation, Arlington, Tex.

[21] Appl. No.: 418,773

[22] Filed: Apr. 7, 1995

[51] Int. Cl.[6] ..... C21D 1/30

[52] U.S. Cl. ..... 148/590; 148/592; 148/594; 148/633; 148/638; 148/606; 148/607; 210/222

[58] Field of Search ..... 148/660, 661, 148/606, 607, 667, 286, 280, 633, 638, 590, 594, 592

[56] References Cited

U.S. PATENT DOCUMENTS

| | | | |
|---|---|---|---|
| 2,153,906 | 4/1939 | Aborn | 148/607 |
| 2,340,461 | 2/1944 | Gage | 148/286 |
| 3,065,119 | 11/1962 | Brautigam | 148/607 |
| 3,097,980 | 7/1963 | Swarr | 148/607 |
| 3,235,415 | 2/1966 | Palty | 148/607 |
| 4,154,629 | 5/1979 | Asai | 148/606 |
| 4,432,811 | 2/1984 | Steibellehner | 148/592 |

FOREIGN PATENT DOCUMENTS

| | | | |
|---|---|---|---|
| 0276123 | 7/1970 | U.S.S.R. | 148/607 |

*Primary Examiner*—Sam Silverberg
*Attorney, Agent, or Firm*—Jack A. Kanz

[57] ABSTRACT

Martensitic steel components of apparatus for magnetic conditioning of liquids which are subjected to cathodic reaction and degradation are treated prior to use to form a barrier of iron-chromium oxide and a uniform level of hardness throughout by heating the steel to a temperature near the grain boundary temperature of the steel, maintaining that temperature for a specified period and then rapidly quenching the steel.

2 Claims, 2 Drawing Sheets

APPARATUS FOR MAGNETIC CONDITIONING OF LIQUIDS AND METHODS OF MAKING SAME

This invention relates to apparatus for magnetic treatment of calcareous water and other aqueous and non-aqueous streams. More particularly, it relates to methods of treating steel components of such apparatus to protect the apparatus from deterioration and degradation while in use.

BACKGROUND OF THE INVENTION

Techniques for the magnetic treatment of calcareous water require flow of the liquid through a zone of high density magnetic flux provided by magnetic devices with ferrous based or electrically powered magnets which generate a high density magnetic flux. The primary objective of the magnetic treatment is to assure dispersion and decontamination of caustic elements in the water to the fullest extent possible.

Common to these treatment devices is the problem of structural degradation or decomposition of surface areas in contact with the calcareous water. Of special importance is the degradation of venturi areas within the apparatus which are particularly susceptible to degradation because of the caustic environment created by the high density magnetic flux. This is especially so if the venturi area or region is fabricated from materials tending toward the cathodic aspect of metals or, in the alternative, a cathodic metal is used which is not treated to withstand the caustic environment in which it is to be immersed. If the apparatus is left untreated, a naturally-occurring chemical reaction takes place between the cathodic metals and the anodic metals within the water treatment equipment. Accordingly, there is a need for means to limit degradation of fluid treatment structures used in high density magnetic flux devices for treating and conditioning fluids.

SUMMARY OF THE INVENTION

In accordance with the present invention martensitic steel components intended for use in high density magnetic flux devices are subjected to a treatment process wherein the steel is gradually heated over a first predetermined period to a grain boundary temperature of the steel. The steel is then maintained at the grain boundary temperature for a second predetermined period, after which the steel is rapidly quenched in quench bath of water-soluble oil and water. This process forms a uniform lattice structure throughout the steel and an iron-chromium oxide barrier on the exterior of the steel. The uniform lattice structure translates to a uniform level of hardness throughout the steel to better endure immersion in caustic solutions and fluids. Other features and advantages of the invention will become more readily understood from the following detailed description taken in connection with the appended claims and attached drawing in which:

DESCRIPTION OF PREFERRED EMBODIMENT

Figure 1:
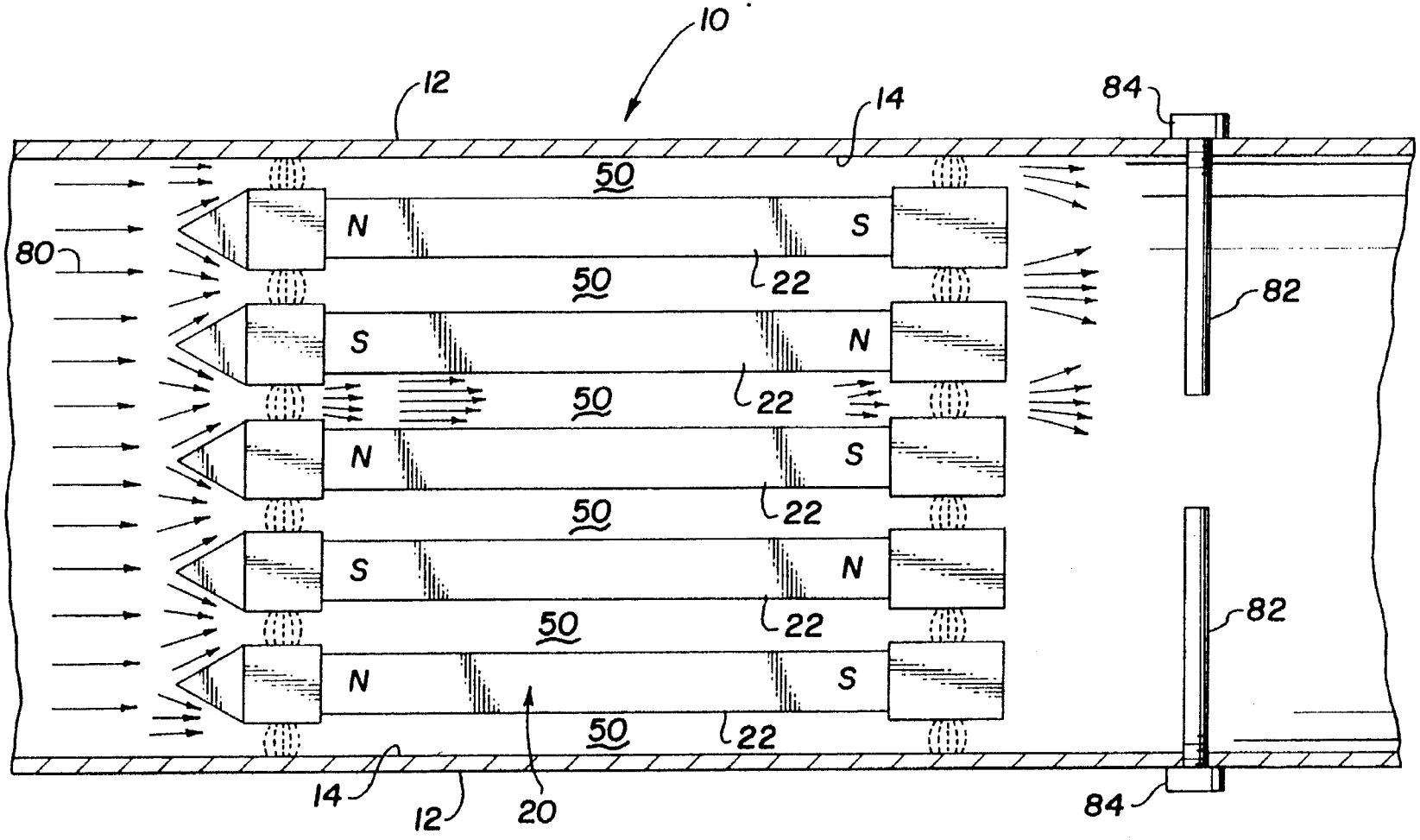
FIG. 1 is a plan view, shown partly broken away, of apparatus in which the treatment process of the invention can be employed.

Various embodiments of the invention are illustrated herein in combination with a fluid conditioner 10 comprising a housing 12 having an inner sidewall surface 14 and a permanent magnet grouping of unitary construction 20 arranged parallel within the housing 12 as shown in FIG. 1. For a detailed description of such fluid conditioners, reference may be had to U.S. Pat. No. 4,278,549, the specification of which is incorporated herein by reference.

The housing 12 can be of any suitable shape such as an oval, a polygon or a rectangle. The housing 12 can be formed of any durable material which has impact and solvent resistant properties (particularly with respect to both low and high temperature fluids) such as synthetic polymers or alloy metals. However, the inner sidewall 14 should have a high magnetic permeability to allow a flux field 60 between a magnetic assembly 22 and the sidewall 14. The permeability can be provided and integrally constructed with sidewall 14 and housing 12. Otherwise, a magnetic assembly 22 can be secured adjacent the sidewall 14 to ensure a continuous flux field across the cross-section of the housing 12 to engage the flow 80.

Figure 2:
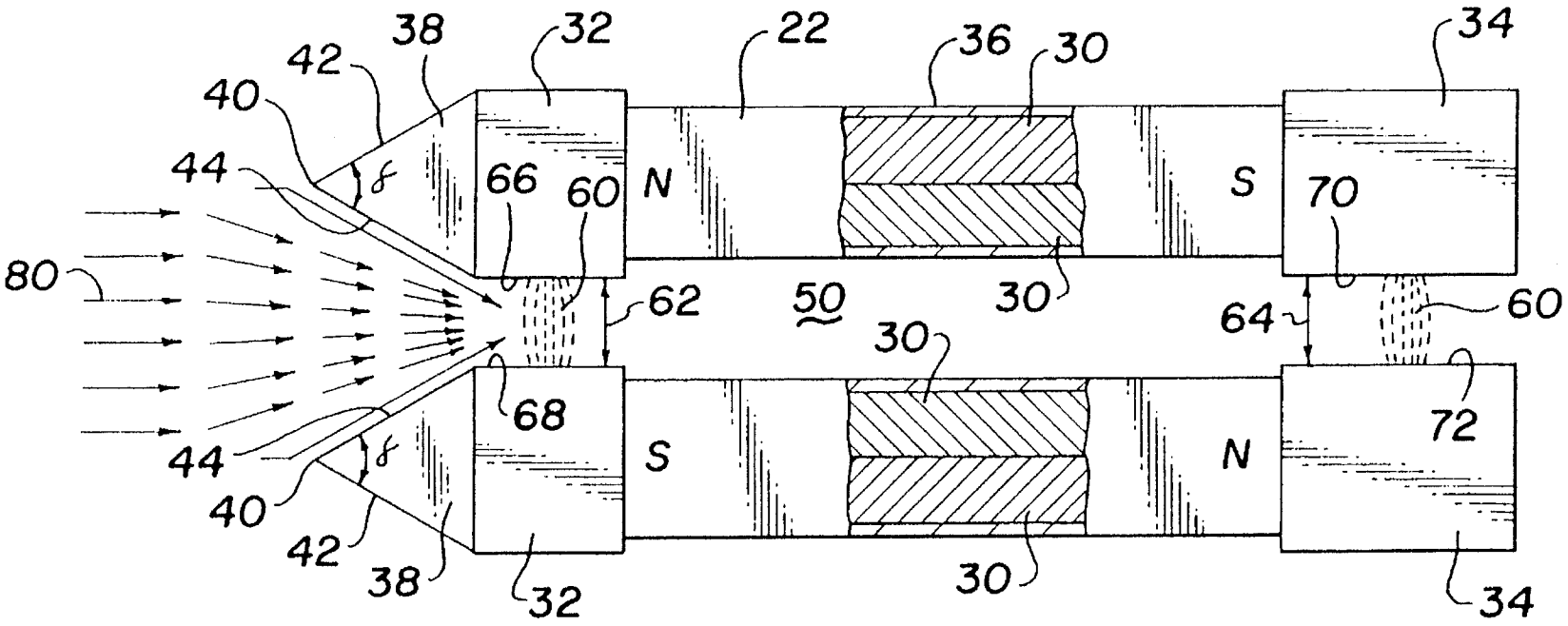
FIG. 2 is an exploded view of a portion of the apparatus of FIG. 1.

The magnet grouping 20 comprises a plurality of magnet assemblies 22 as shown in FIG. 1. For clarity of illustration, a pair of assemblies 22 with opposing polarizations are depicted in FIG. 2. The magnet assembly 22 comprises a plurality of superimposed, coaxially arranged bar magnets 30 polarized along their respective longitudinal axes. The magnets 30 each terminate in a proximal end portion 32 and distal end portion 34 joined by a shank portion 36. The proximal end portion 32 comprises a head portion 38 having a generally rectangular cross-section and a tip or deflecting edge 40 centered and substantially perpendicular to the magnet assembly 22. The head portion 38 is tapered to counter the direction of a primary flow and to provide complementary deflecting surfaces 42 and 44, respectively, which converge to provide deflecting edge 40. The taper of the deflecting surfaces 42 and 44 is preferably about twenty degrees to about sixty degrees (designated as the angle $\alpha$). The distal end portion 32 is rectangular in cross-section with an axis coincident with the longitudinal axis of the magnet assembly 22 as shown in FIG. 2.

The magnet assemblies 22 are arranged to provide a plurality of venturi regions of annular flow paths 50 defined by adjacent magnet assemblies 22 and the sidewall surface 14 as best shown in FIG. 1. Referring to FIG. 2, magnetic flux fields 60 are generated across gaps 62 and 64 between adjacent opposite face surfaces 66 and 68 and 70 and 72, respectively.

In operation, a mass of calcareous water enters the water conditioner 10 along a primary flow direction 80 generally depicted by flow vectors as shown in FIGS. 1 and 2. The water mass 80 encounters the deflecting surfaces 44 to engage the flux field 60. Assuming a relatively constant flow rate through the conditioner 10, the local velocity of the deflected water is increased through the constriction formed by opposing proximal head ends 38 to generate a venturi effect on the flow. Generally, the lateral dimension of the head portion 38 should exceed that of the shank portion 36 by a factor preferably from about 1.2 to 1.5 inches (3.0 cm to 3.8 cm) in order to achieve optimum venturi effects.

The resulting flow turbulence in the venturi regions 50 provides a thorough mixing action which is conducive to dispersing molecular complexes or other caustic materials which may have been precipitated as a result of engaging the magnetic flux fields 60. Passage through the flux field 60 by the turbulent water mass 80 confers the benefit of reducing the scaling and encrusting tendencies of the water.

After passage through the venturi regions 50, the water mass 80 encounters a pair of anodes 82. The anodes 82 are detachably mounted to the side wall 14 by screw cap members 84 as shown in FIG. 1. The anodes 82 are preferably formed of a compound incorporating a Class II anodic metal such as magnesium. The anodes 82 project from an approximate vertical midpoint of the sidewall portion 14 into the primary flow path 80 of the magnetically treated water.

The anodes 82, submerged in the aqueous flow 80, provide protective ions which function to limit the destructive effects of electrolytic or galvanic reactions on the process equipment and piping. Regarding the water conditioner 10, the shank portions 36, for example, of the magnet assemblies 22 are typically cathodic in the aqueous solution, causing a chemical reaction between the cathodic properties of the shank 36 and the anodes 82. This reactive potential causes degradation and decomposition of the shanks 36, reducing the effectiveness of the venturi regions 50.

The present invention addresses degradation of materials in the process equipment which diminishes the effectiveness of the venturi regions 50 of the water conditioner 10. Generally, the venturi areas 50 deteriorate in proportion to the anodic requirements for proper water conditioning.

To reduce the tendency of the venturi areas 50 to deteriorate, the shanks 36 are preferably made of cathodic resistant material such as a martensitic steel alloy having at least ten percent chromium. Such steel alloys are carpenter 17-4 and sandcrow 28. These alloys have been found to have an optimal capacity to withstand the caustic environment within the water conditioner 10 because of their "stainless" characteristics caused by a tight adherent film of iron-chromium oxide barrier on the surface which strongly resists corrosion.

In accordance with the invention, the internal lattice structure of a martensitic steel alloy is uniformly arranged throughout a preformed piece of steel such as the sheath 36. Additionally, an iron-chromium oxide barrier is formed on the exterior of the preformed piece of steel, such as the sheath 36, which is formed of martensitic steel alloy such as carpenter 17-4 or sandcrow 28. The steel alloy is gradually heated over a predetermined period (preferably of about eight hours) in a substantially inert atmosphere to a temperature almost sufficient to melt the steel, thereby attaining the steel's grain boundary temperature. A suitable inert atmosphere is formed by a nitrogen blanket.

Typically, a grain boundary occurs in cold-worked steel. When the cold steel is machined, frictional or tensile forces generate localized heating of the steel, causing internal lattice structure demarcations or grain boundaries. The grain boundary is formed by the dislocated axial orientation of the steel's lattice structure. The grain boundary temperature, as used herein, is the temperature at which the internal lattice structure of the steel is relaxed, allowing entrapped carbon within the steel to flow and disperse throughout the steel. For example, the steel referred to is heated preferably to about 1950° F. (about 1187° C.), short of the alloy's melting temperature of 2200° F. (about 1343° C.). The steel referred to is heated from about 55° F. (2.4° C.) to about 1000° F. (593° C.) over a first predetermined period of about eight hours for a heating rate of approximately 4° F. (2.5° C.) per minute. It is important to not aggressively heat the steel because the outer surface will absorb most of the energy, thereby forming a molten slag and causing the piece to deform.

Normal steel heat treating simply requires that the steel be heated to a temperature of about 800° F. (about 468° C.). Such a lesser temperature does not generate a homogenous distribution of carbon, thereby causing, upon quenching, a non-homogeneous lattice structure having a relatively soft steel core surrounded by a harder outer steel region which would not have the properties achieved by the invention.

After achieving the grain boundary temperature, the temperature of the steel alloy is maintained for a second predetermined period of preferably about eight hours in the substantially inert atmosphere. Maintaining the temperature level of the alloy causes the internal lattice structure to further relax, urging entrapped carbon to leach and permeate the alloy to generate a homogenous carbon distribution.

After the alloy temperature has been maintained for the second predetermined period, the metal is rapidly quenched. Quenching is preferably performed in an emulsion comprising equal parts of a soluble oil and water to stabilize the lattice structure within the steel's matrix. The oil is preferably a heat transfer oil available from the Texaco Corporation, part no. TX-8759-0786. The solution is described as an emulsion due to the similar specific gravities of the water and the oil. Once the two liquids are combined and dispersed within one another, the two cannot be separated by a centrifuge due to the similar specific gravities—thereby generating an emulsion.

Quenching the alloy in water alone is not acceptable because the water vaporizes and forms a barrier layer, thereby decreasing the alloy's rate of cooling. Quenching by immersing the steel in an emulsion allows the heat transfer oil to contact the steel. Although the water near the steel is vaporized, the vapors are dispersed in the emulsion and the emulsion maintains uniform contact with the steel without forming a superheated barrier. This produces an unusually rapid quench rate which prevents undue distortion of the lattice structure of the steel.

The quenching process lasts about three (3) to five (5) minutes, a time sufficient to cool the steel to about 100° F. (about 30° C.). An adequate quantity of quenching solution, for example, is forty gallons for an eighteen inch long piece with a two inch diameter for sufficient heat transfer. After quenching, the steel piece has a uniform lattice structure throughout. Unlike conventional heat treatments, the steel core and the outer surface have a uniform degree of hardness throughout.

Although the invention has been described with particular reference to specific embodiments thereof, the forms of the invention illustrated are to be taken as illustrative of the principles thereof. Accordingly, it is to be understood that the forms of the invention shown and described in detail are to be considered examples only and that various changes, modifications and rearrangements may be resorted to without departing from the spirit and scope of the invention as defined by the appended claims.

What is claimed:

1. A method of increasing corrosion resistance of a magnetic assembly used for treatment of calcareous liquids wherein the assembly has a machined martensitic steel element, the method comprising the steps of:

(a) gradually increasing the temperature of a machined martensitic steel element over a period of time and in a substantially inert atmosphere until a grain boundary temperature of about 1187° C. and below the melting point of the steel is reached;

(b) maintaining said element at said temperature of about 1187° C. in said substantially inert atmosphere for period of about eight (8) hours to relax tho internal lattice structure of said element and promote homogenous distribution of carbon entrapped in said element; and (c) rapidly quenching said element to a temperature of about 100° C. or lower by substantially submerging it in an emulsion of water and water-soluble oil having a specific gravity substantially similar to water.

2. A method as set forth in claim 1 wherein said martensitic steel is selected from the group consisting of Carpenter 17-4 steel alloy and Sandcrow-28 steel alloy.

* * * * *

UNITED STATES PATENT AND TRADEMARK OFFICE

CERTIFICATE OF CORRECTION

PATENT NO. : 5,605,587
DATED : February 25, 1997
INVENTOR(S) : John H. Meckling

It is certified that error appears in the above-indentified patent and that said Letters Patent is hereby corrected as shown below:

Col. 5, line 1, "tho" should read ---the---

Signed and Sealed this

Twenty-fourth Day of June, 1997

Bruce Lehman

*Attest:*

BRUCE LEHMAN

*Attesting Officer*

*Commissioner of Patents and Trademarks*